United States Patent [19]

Johnson

[11] 4,372,189

[45] Feb. 8, 1983

[54] AMPLIFICATION ARRANGEMENT FOR VIOLIN SOUND BARS

[76] Inventor: Charles S. Johnson, 5208 12th St., So., Arlington, Va. 22204

[21] Appl. No.: 347,980

[22] Filed: Feb. 11, 1982

[51] Int. Cl.[3] ..... G10D 3/02

[52] U.S. Cl. ..... 84/276; 84/294

[58] Field of Search ..... 84/274–277, 84/294

[56] References Cited

U.S. PATENT DOCUMENTS

| | | | |
|---|---|---|---|
| 661,412 | 11/1900 | Lowenthal | 84/276 |
| 1,042,287 | 10/1912 | Shaw | 84/276 |
| 1,861,682 | 6/1932 | Bonewitz | 84/294 X |

FOREIGN PATENT DOCUMENTS

| | | | |
|---|---|---|---|
| 598164 | 5/1933 | Fed. Rep. of Germany | 84/276 |

*Primary Examiner*—Lawrence R. Franklin

*Attorney, Agent, or Firm*—Larson and Taylor

[57] ABSTRACT

A violin or like stringed musical instrument is provided which includes a weight member incorporated in the standard sound bar located under the left foot of the bridge of the violin. The weight member, which is preferably fabricated of lead or the like, is located approximately midway between the bridge and the upper end of the hollow body of violin and has weight of less than about one gram. This simple expedient provides a very substantial increase in the volume of the sound produced by the violin.

3 Claims, 2 Drawing Figures

AMPLIFICATION ARRANGEMENT FOR VIOLIN SOUND BARS

FIELD OF THE INVENTION

The present invention relates to violins and like stringed musical instruments and, more particularly, to enhancing the volume of the sound produced by such instruments.

BACKGROUND OF THE INVENTION

A number of attempts have been made in the prior art to increase the sound output of stringed musical instruments such as violins. Some of these techniques include the use of various forms of strips, ribs and bars as well as so-called "vibrative elements", such as disclosed in U.S. Pat. No. 2,068,078 (Samuelson). The Samuelson patent discloses a stringed musical instrument wherein a plurality of such vibrative elements are disposed either inside or outside of the sound box at specific locations, and a vibration-damping bar is located between two groups of the elements with the ends of the bar spaced from the elements. In one embodiment, the bar extends through a groove in another one of the vibrative elements, the latter being glued to the bottom surface of the belly of the sound box. U.S. Pat. No. 1,671,532 (Lemansky et al) discloses a stringed musical instrument including a sounding bar made of two wooden pieces whose adjacent ends are enclosed by a sheet silver shell in which two ground glass bodies are loosely inserted. In U.S. Pat. No. 1,887,398 (Chase), a violin is disclosed which includes a sound bar that is enlarged at the junction of the neck and body of the violin. A sound bar having a plurality of holes therein is disclosed in U.S. Pat. No. 661,412 (Rowenthal).

While, in general, the sound bars and other techniques used in the prior art are considered to provide various degrees of sound enhancement, none of these techniques combines the kind of increase in sound volume with the simplicity in construction that is afforded by the present invention.

SUMMARY OF THE INVENTION

According to the invention, a sound enhancing arrangement for violins and the like is provided which is extremely simple in construction but which nevertheless provides very marked increases in sound volume output without loss of tone quality. The invention is an improvement on conventional violins which include a sound bar beneath the left foot of the bridge and concerns the provision of a sound amplifying weight member of a particular weight incorporated in the sound bar at a predetermined location. In particular, the weight of the weight member is less than about one gram and preferably on the order of ½ gram, while the location of the weight in the violin along the bass bar is approximately midway between the bridge and the upper end of the hollow body of the violin. A small piece of lead is advantageously used as the weight member although other metals, and even other materials, can be employed.

It has been found that this extremely simple expedient provides a very substantial increase in the volume of the sound produced by the violin. In fact, in tests made with a conventional sound level meter, the tone, when unaided, registers from minus ten to zero and in some instances, up to plus one; with the invention, a reading of up to plus seven and, in some instances, eight has been recorded, an increase of about seven or eight decibels. Moreover, this increase in sound has been produced with no decrease in the quality of the tone.

Other features and advantages of the invention will be set forth in, or apparent from, the detailed description of the preferred embodiments which follows.

DESCRIPTION OF THE PREFERRED EMBODIMENT

Figure 1:
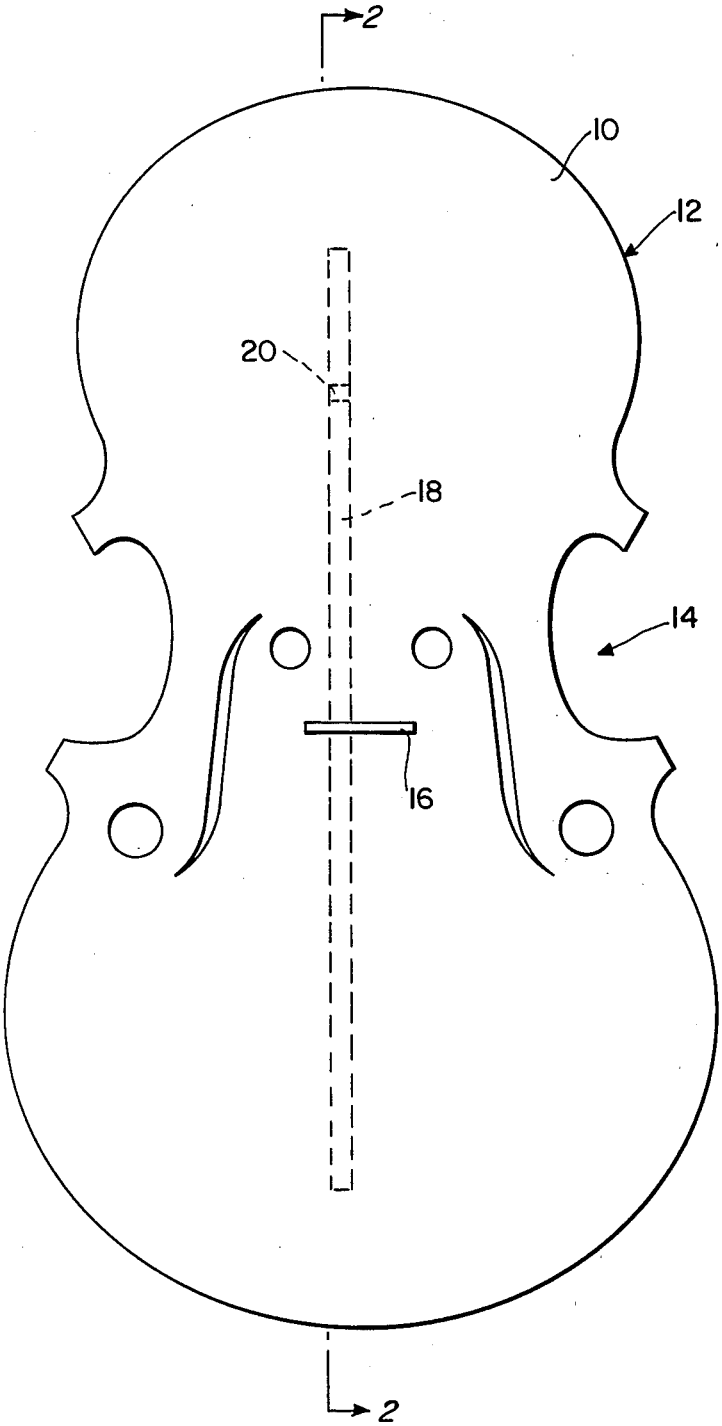
FIG. 1 is a plan view of the body portion of a violin incorporating the invention.
Figure 2:
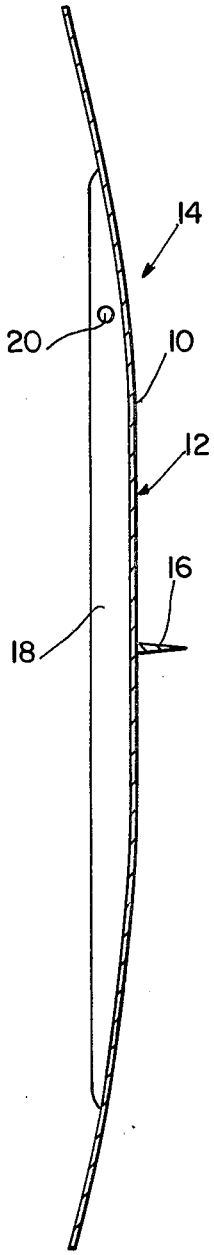
FIG. 2 is a partially broken away cross section of the body portion shown in FIG. 1.

Referring to the drawings, the top or upper face 10 of the hollow body portion 12 of a conventional violin, generally denoted 14, is shown which includes a standard bridge 16 located thereon. As can be best seen in FIG. 1, a generally conventional sound bar 18 is located within hollow body portion 12 under the left foot of bridge 16, as is standard practice.

In accordance with the invention, a sound enhancing weight member 20 is inserted into sound bar 18. As discussed above, the location and weight of weight member 20 have been found to be critical in practice and, as shown in FIG. 1, weight member 20 is located in sound bar 18 approximately half-way between the upper end of body 12 and bridge 16. The weight of weight member 20 is less than about one gram and, in a preferred embodiment that has produced particularly good results, is approximately ½ gram. The weight member 20 is advantageously made of lead although other metals, and conceivably other materials can be used. In a specific embodiment, a ¼ inch roll of lead about the size of the graphite in a pencil was used.

As discussed above, in testing conducted with a sound level meter an improvement (increase) to seven or eight decibels has been recorded for all notes tested, with no decrease in the tone quality. This increase in sound volume augments modulation and provides the violinist with an added dimension in performing.

Although the invention has been described relative to an exemplary embodiment thereof, it will be understood by those skilled in the art that variations and modifications can be effected in this exemplary embodiment without departing from the scope and spirit of the invention.

I claim:

1. In a violin or like instrument including a hollow body, a bridge located on the hollow body and a wooden sound bar located within the hollow body under the left foot of the bridge, the improvement comprising a sound enhancing metallic weight member inserted into the sound bar at a location approximately one half of the distance between the bridge and the upper end of the hollow body of the violin, and of a weight of less than about one gram.

2. A violin as claimed in claim 1 wherein the weight of said weight member is approximately ½ gram.

3. A violin as claimed in claim 1 wherein said weight member comprises a lead weight member.

* * * * *